US007408758B2

(12) United States Patent
Myers et al.

(10) Patent No.: US 7,408,758 B2
(45) Date of Patent: Aug. 5, 2008

(54) STATIC ELECTRICITY DETECTION FOR FUEL DISPENSER

(75) Inventors: Howard M. Myers, Greensboro, NC (US); Thomas J. Park, Greensboro, NC (US); Benjamin T. Siler, Stokesdale, NC (US)

(73) Assignee: Gilbarco Inc., Greensboro, NC (US)

( * ) Notice: Subject to any disclaimer, the term of this patent is extended or adjusted under 35 U.S.C. 154(b) by 426 days.

(21) Appl. No.: 11/070,701

(22) Filed: Mar. 2, 2005

(65) Prior Publication Data

US 2006/0198076 A1 Sep. 7, 2006

(51) Int. Cl.
*H05F 3/00* (2006.01)

(52) U.S. Cl. ..... 361/215

(58) Field of Classification Search ..... 361/215
See application file for complete search history.

(56) References Cited

U.S. PATENT DOCUMENTS

| | | | | |
|---|---|---|---|---|
| 2,764,948 | A * | 10/1956 | Jones | 417/410.1 |
| 3,013,578 | A * | 12/1961 | Askevold | 137/487.5 |
| 3,164,747 | A * | 1/1965 | Yahnke | 361/215 |
| 3,821,603 | A * | 6/1974 | De La Cierva | 361/215 |
| 5,267,592 | A | 12/1993 | Kaplan et al. | 141/387 |
| 5,267,670 | A | 12/1993 | Foster | 222/1 |
| 5,365,984 | A | 11/1994 | Simpson et al. | 141/387 |
| 6,163,445 | A | 12/2000 | Zoellick | 361/78 |
| 6,378,562 | B1 | 4/2002 | Noone et al. | 138/137 |
| 6,401,767 | B1 | 6/2002 | Cohen et al. | 141/1 |
| 7,013,930 | B2 * | 3/2006 | Mann | 141/1 |
| 7,096,895 | B2 * | 8/2006 | Barker | 141/94 |
| 2004/0154687 | A1 | 8/2004 | Mann | 141/1 |
| 2004/0206418 | A1 | 10/2004 | Davis | 141/97 |

* cited by examiner

*Primary Examiner*—Ronald W Leja
(74) *Attorney, Agent, or Firm*—Nelson Mullins Riley & Scarborough LLP

(57) ABSTRACT

A fueling environment's safety is improved by adding static charge sensors to the fuel dispenser and its peripherals. The static charge sensors detect static charge proximate the fuel dispenser and provide an indication of the static charge to a threshold detector. If the static charge is above a predetermined threshold, one or more safety devices may be activated to disperse or reduce the amount of hydrocarbon vapors proximate the fuel dispenser. Reduction in the amount of hydrocarbon vapors proximate the fuel dispenser helps reduce the risk of harm from the static charge.

48 Claims, 9 Drawing Sheets

STATIC ELECTRICITY DETECTION FOR FUEL DISPENSER

FIELD OF THE INVENTION

The present invention relates to fueling environments and particularly to detecting fields of static electricity generated by a static charge in the fueling environment.

BACKGROUND OF THE INVENTION

Fueling environments handle fuels that are dispensed, and thus safety issues are always of concern. For example, it is possible that, in the right environmental conditions, there may be enough of a static electrical charge accumulated to generate a spark. In normal environments, such a spark shocks the recipient and may provide some brief period of discomfort. However, in a fueling environment that has hydrocarbon vapors lingering about the fuel dispensers, such a spark may be more dangerous.

Currently, most fuel dispensers display warnings about the risks associated with static electricity. However, there are currently no known commercially deployed devices which detect the presence of an elevated static charge proximate a nozzle of a fuel dispenser in a fueling environment. In light of the issues associated with such static charges, there is a need for a device that detects static charge proximate the fuel dispenser and has the capability to improve the safety of fuel dispenser users when such a static charge is detected.

SUMMARY OF THE INVENTION

The present invention addresses the problems of the prior art by providing a static charge sensor at various places within the fueling environment to sense whether a static charge is present. If a static charge above a predefined threshold is detected by the static charge sensor, a controller associated with the static charge sensor may generate an alarm or invoke certain safety measures to alleviate risks associated with the elevated static charge.

The static charge sensor is, in a contemplated embodiment, a wire probe that is connected to an amplifier and threshold detector circuit. As an electric field is generated by a static charge, the resulting charge collects on the wire probe, and a current is induced in the wire. The amplifier amplifies the induced current and provides the amplified current to a resistive component associated with the threshold detector circuit. The threshold detector circuit uses the voltage across the resistive component to determine if the static charge is above the predefined threshold.

If the threshold detector circuit determines that the static charge at the static charge sensor exceeds the predetermined threshold, the detector circuit causes one or more safety measures to be invoked. The safety measures include, but are not limited to, shutting off a flow control valve, shutting off a fueling environment fuel pump, turning off a dispenser fuel pump, generating an alarm for the site operator, generating an alarm at a remote location, turning on a fan to dissipate fuel vapors, and the like. These safety measures are designed to help limit hydrocarbon vapors, or, at a minimum alert the user of the risk of a spark, such that if a spark were to be emitted, there would be a reduced likelihood of a fire or other damage.

The static charge sensors of the present invention may be positioned in a number of places in a fueling environment, including, but not limited to the nozzle, the edge of the housing of the fuel dispenser, the face of the fuel dispenser, the canopy of the fuel dispenser, and the like. The various placements are designed to increase the likelihood that a static charge will be sensed.

The static charge sensor is, in a specifically contemplated embodiment, a wire with a small radius on its terminal end. The small radius increases field strength to make static charge detection easier. The wire is protected from being hit accidentally by a grounded physical barrier such as a grounded wire screen or the like. The wire screen includes openings large enough to allow some of the electric field to reach through the screen and impinge upon the wire. Other static charge sensors are also contemplated.

Those skilled in the art will appreciate the scope of the present invention and realize additional aspects thereof after reading the following detailed description of the preferred embodiments in association with the accompanying figures.

BRIEF DESCRIPTION OF THE DRAWINGS

The accompanying figures incorporated in and forming a part of this specification illustrate several aspects of the invention, and together with the description, serve to explain the principles of the invention.

DETAILED DESCRIPTION OF THE PREFERRED EMBODIMENTS

The embodiments set forth below represent the necessary information to enable those skilled in the art to practice the invention and illustrate the best mode of practicing the invention. Upon reading the following description, and in light of the accompanying figures, those skilled in the art will understand the concepts of the invention and will recognize applications of these concepts not particularly addressed herein. It should be understood that these concepts and applications fall within the scope of the disclosure and the accompanying claims.

The present invention is directed to sensing a static charge in a fueling environment and invoking one or more safety measures to minimize risks associated with the detected static charge. To this end, the present invention positions static charge sensors at various locations on a fuel dispenser and its peripherals and/or in the surrounding environs. The static charge sensors provide input to a threshold detector circuit that determines if any sensor has detected a static charge above a predetermined threshold. If a static charge above the predetermined threshold is detected, one or more safety measures are invoked to alert someone as to the existence of the static charge to reduce the likelihood of a spark causing a fire or other damage.

Figure 1:
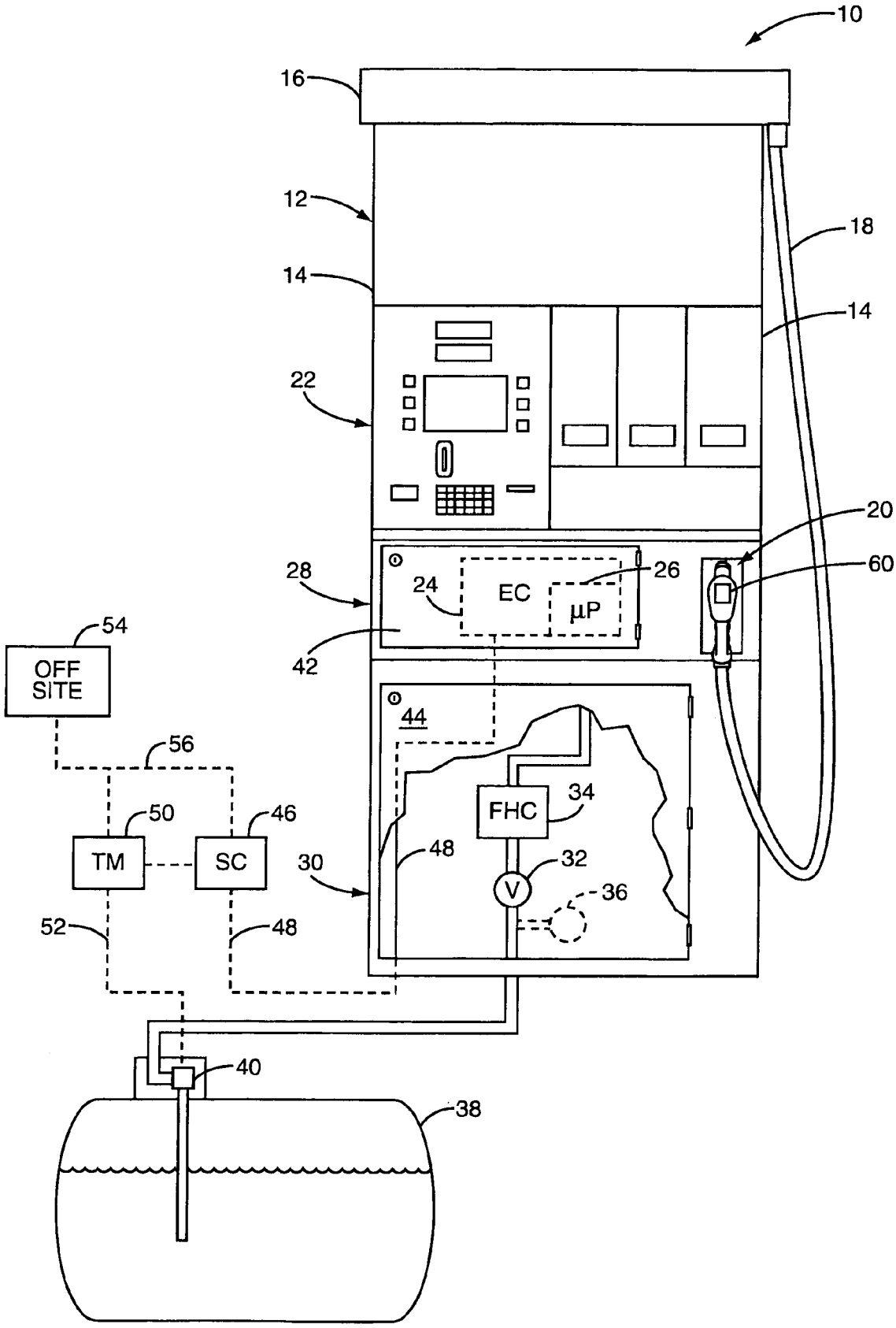
FIG. 1 illustrates a fuel dispenser within a fueling environment with a static charge sensor disposed thereon.

FIG. 1 illustrates a fuel dispenser 10 that shows one partial embodiment of the present invention. The fuel dispenser 10 includes a housing 12, having edges 14, a fuel dispenser canopy 16, a hose 18, and a nozzle 20. An exemplary fuel dispenser 10 may be the ENCORE® or the ECLIPSE® sold by Gilbarco Inc. of 7300 W. Friendly Avenue, Greensboro, N.C. 27410. The fuel dispenser 10 includes a user interface 22 that connects to electronic components (EC) 24, including a dispenser controller (μP) 26, positioned within an electronics chamber 28. The user interface 22 has audio and visual components for conveying information to a user and inputs to accept the user's instructions. The housing 12 also includes a fuel handling chamber 30 in which a flow control valve 32 and other conventional fuel handling components 34 (FHC) may be positioned.

Additionally, some fuel dispensers 10 may include a fuel dispenser pump 36 (shown dotted), which pumps fuel from an underground storage tank 38. If the fuel dispenser pump 36 is not present, the fuel dispenser 10 receives fuel from the underground storage tank 38 via a submersible turbine pump 40 such as the RED JACKET® pumps sold by Marley Pump of Veeder-Root of 125 Powder Forest Drive, Simsbury, Conn. 06070.

Electronics chamber 28 may be selectively accessed through a door 42, and fuel handling chamber 30 may be selectively accessed by a door 44. In normal operation, doors 42 and 44 are locked, as is well understood. The doors 42 and 44 may be variously sized or repositioned on the housing 12 as needed or desired. The illustrated doors 42 and 44 are exemplary and are not intended to be limiting.

The fuel dispenser 10, and particularly the dispenser controller 26, may communicate with a site controller (SC) 46, which may be the G-SITE® sold by Gilbarco. The communication between the dispenser controller 26 and the site controller 46 may be through a conventional communication link 48. The submersible turbine pump 40 may communicate with a tank monitor 50 such as a TLR-350R sold by Veeder-Root. The communication between the submersible turbine pump 40 and the tank monitor 50 may be through a conventional communication link 52. The site controller 46 may communicate with the tank monitor 50 as needed or desired. The site controller 46 and/or the tank monitor 50 may report to an off site location 54 through an off site communication link 56 if needed or desired. While shown as a single communication link 56, it should be appreciated that both the site controller 46 and the tank monitor 50 may each have its own dedicated communication link to the off site location 54. To this extent, both the site controller 46 and the tank monitor 50 are referred to herein as site communicators. The site communicators may communicate to the same or different off site locations 54 as needed or desired.

It should be appreciated that different types of fuel dispensers 10 may be used with the present invention, and the exemplary products described above are not intended to be limiting.

The fuel dispenser 10 includes one or more static charge sensors 60. In FIGS. 1-4, the static charge sensor 60 is shown positioned on the nozzle 20, although other placements are also possible as explained in greater detail below.

Figure 2:
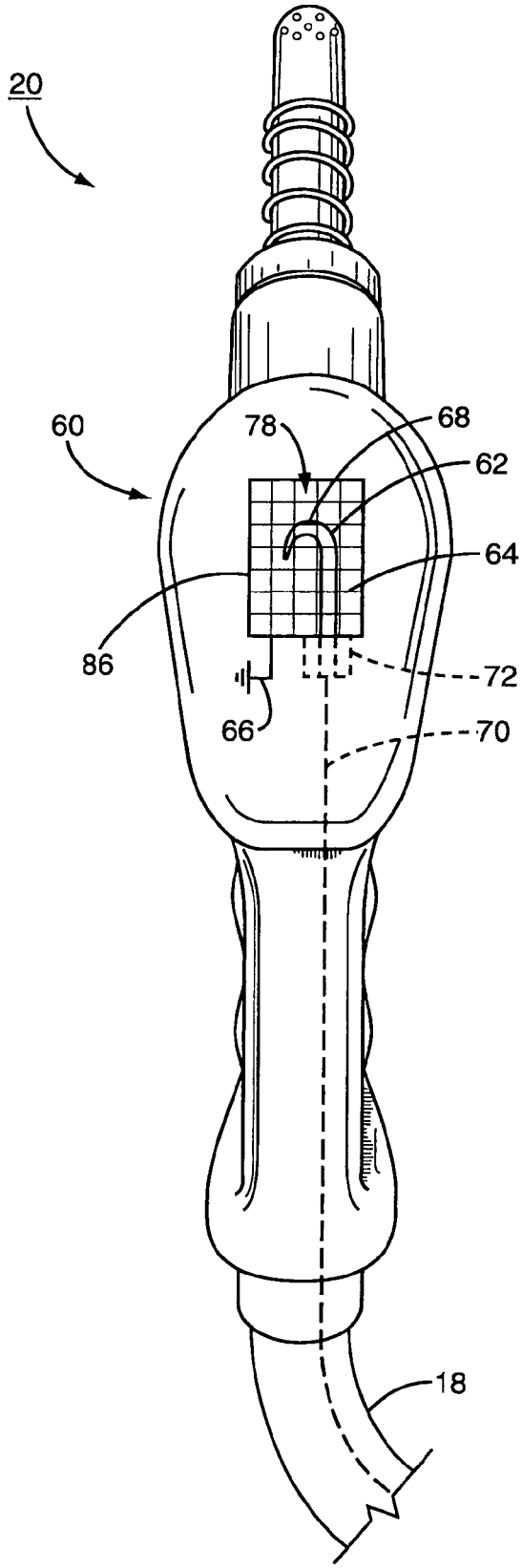
FIG. 2 illustrates an exemplary static charge sensor positioned in a nozzle according to one embodiment of the present invention.
Figure 3:
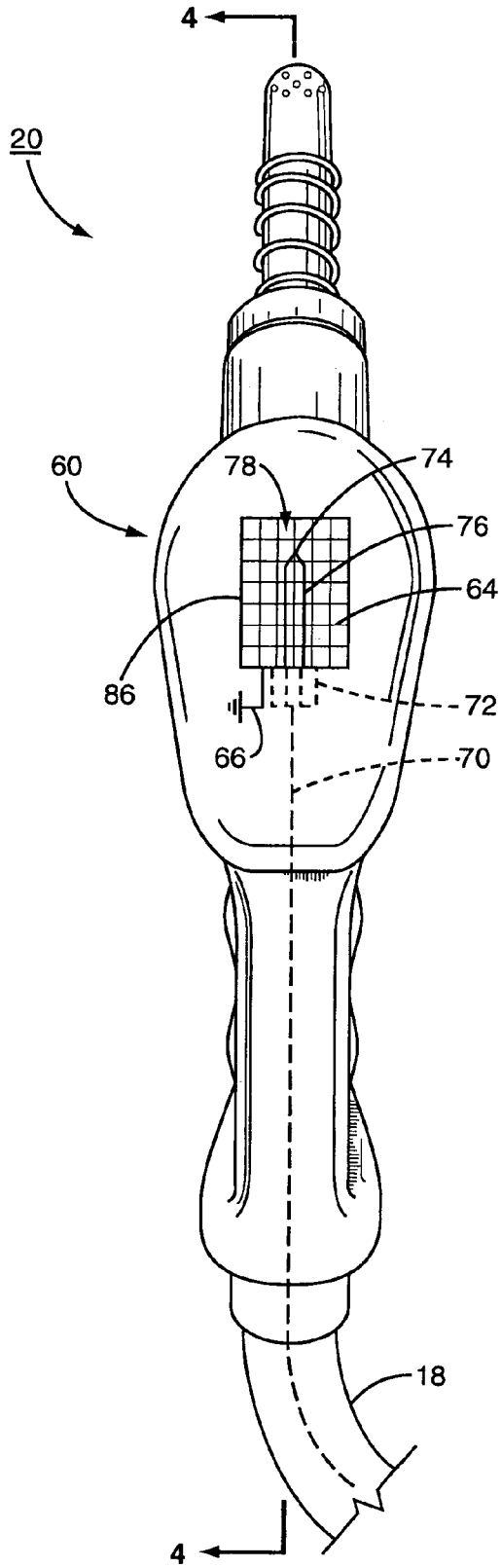
FIG. 3 illustrates a second exemplary static charge sensor positioned in a nozzle according to a second embodiment of the present invention.
Figure 4:
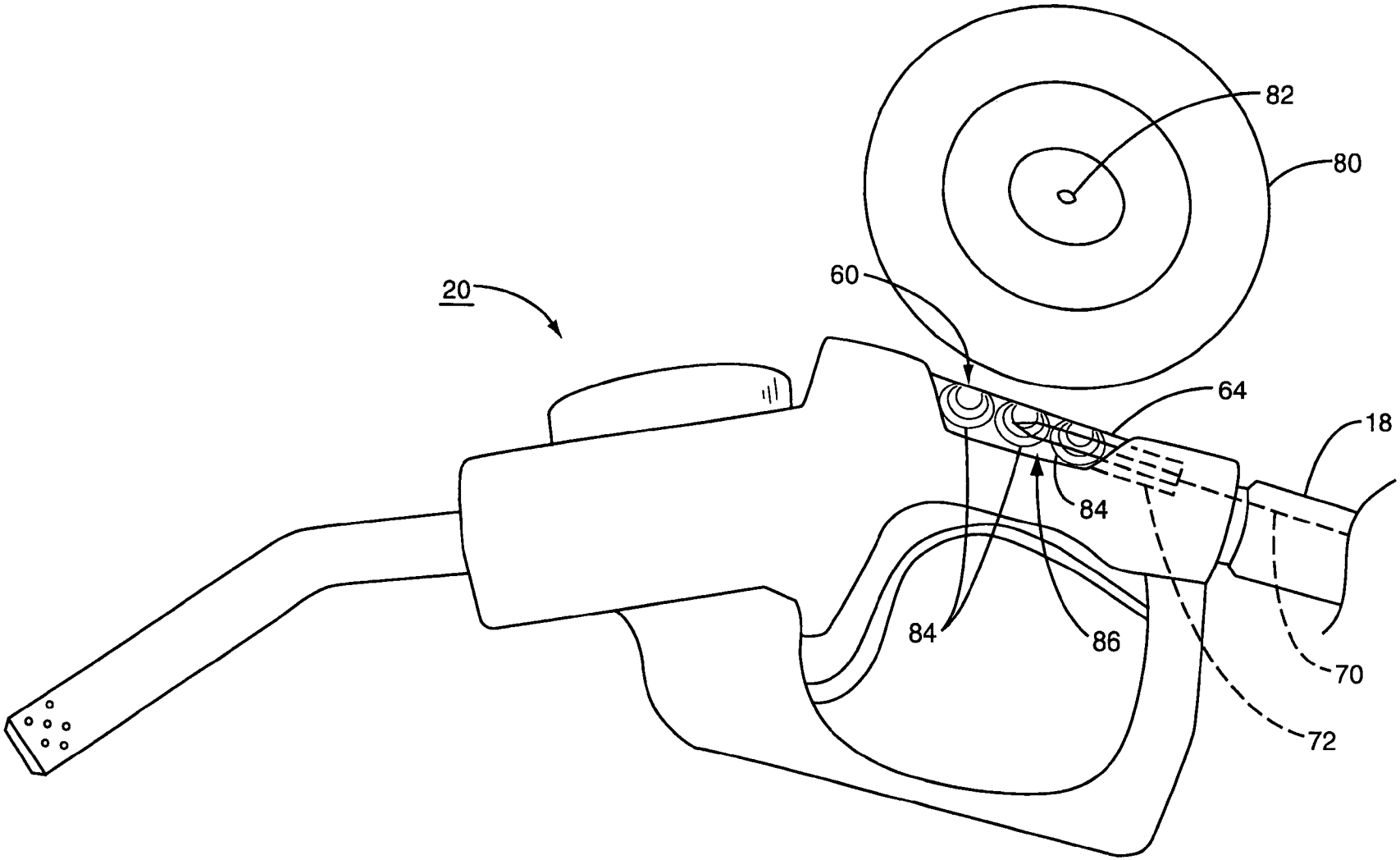
FIG. 4 illustrates a side view of the nozzle with the static charge sensor of FIG. 3.

Two exemplary static charge sensors 60 are presented in FIGS. 2 and 3, and a cross sectional view of the static charge sensor 60 of FIG. 3 is provided in FIG. 4. The static charge sensor 60 of FIG. 2 comprises a generally hook shaped wire electrode 62 positioned beneath a wire mesh 64. The wire mesh 64 is coupled to an electric ground 66. The generally hook shaped wire electrode 62 has a small radius of curvature 68 around the terminal portion of the hook so as to concentrate charge on the generally hook shaped wire electrode 62. The concentrated charge on the generally hook shaped wire electrode 62 induces a current in the static charge sensor 60 as explained below. The generally hook shaped wire electrode 62 may alternatively be considered to be in a "J" shape. The generally hook shaped wire electrode 62 is electrically coupled to an electrically conductive wire 70, which has insulation 72 therearound to form an insulated wire. It is possible that the element that grounds the wire mesh 64 forms a twisted pair with the electrically conductive wire 70 if they may be electrically isolated one from the other sufficiently. It is further possible that the grounding element and/or the electrically conductive wire 70 is shielded from electromagnetic interference if needed or desired.

The static charge sensor 60 of FIG. 3 is substantially similar to the static charge sensor 60 of FIG. 2, but in place of the generally hook shaped wire electrode 62, the static charge sensor 60 of FIG. 3 has a pointed terminal end 74 to form pointed electrode 76. Just as the generally hook shaped wire electrode 62 concentrates charge, the pointed electrode 76 also concentrates charge on the pointed terminal end 74. The concentrated charge induces a current in the static charge sensor 60 as explained below. Again, the pointed electrode 76 is protected from accidental contact by the wire mesh 64. In practice, the openings 78 of the wire mesh 64 are large enough to allow an electric field therethrough, but small enough to prevent inadvertent physical contact with the static charge sensor 60.

FIG. 4 illustrates a better example of an electric field 80 passing through the openings 78 of the wire mesh 64. Specifically, FIG. 4 illustrates a point source 82 of static charge that produces the electric field 80 (identified by concentric lines). As the electric field 80 impinges upon the wire mesh 64, the electric field 80 is scattered. However, some portion of the electric field 80 passes through the openings 78 (FIGS. 2 and 3) of the wire mesh 64 and form secondary electric fields 84 within a cavity 86 within which the pointed electrode 76 is positioned. The secondary electric fields 84 impinge upon the pointed electrode 76 (or the generally hook shaped wire electrode 62) and cause electrons to shift within the pointed electrode 76 (or the generally hook shaped wire electrode 62). The movement of the electrons creates a current which may be measured as explained in greater detail below.

Static charge sensors 60 may also be mounted in such a manner as to limit the effects of moisture, which might cause a leakage path to electrical ground for the electrodes 62 and 76. One contemplated technique is to mount the electrodes 62 and 76 within a non-hygroscopic material. Since the material is non-hygroscopic, moisture will not be retained proximate the electrodes, thereby minimizing risk of an inadvertent short or corrosion due to lingering moisture. In the exemplary embodiments, the cavity 86 is positioned on a back or anterior surface of the nozzle 20. As used herein, the word "anterior" as applied to the nozzle 20 means the portion of the nozzle 20 that juts outwardly when the nozzle 20 is stored in a boot on the fuel dispenser 10. Under this definition, the posterior side of the nozzle 20 is the side with the lever whose actuation begins fuel flow, as is well understood. Alternatively, the cavity 86 may be positioned on a side or a posterior surface if needed or desired.

While two exemplary static charge sensors 60 are shown, it should be appreciated that other static charge sensors may be used in place of the exemplary static charge sensors 60 provided. For example, the electrodes 62 and 76 could be replaced with a flat surface pickup.

For further information about how electronic components within a nozzle 20 may be connected to electronic components in a fuel dispenser 10, the interested reader is referred to U.S. Pat. Nos. 5,267,592 and 5,365,984, both of which are hereby incorporated by reference in their entireties. In particular, the details relating to the wiring connections between the nozzle, the hose, and the fuel dispenser may be of interest. Alternatively, if the complexity of the wiring through the hose 18 is too troublesome, it is possible that the electronics of the present invention may communicate wirelessly from the nozzle 20 to the electronic components 24 within the fuel dispenser 10 through a battery powered transmitter in the nozzle 20 and a wireless receiver in the fuel dispenser 10.

Figure 5:
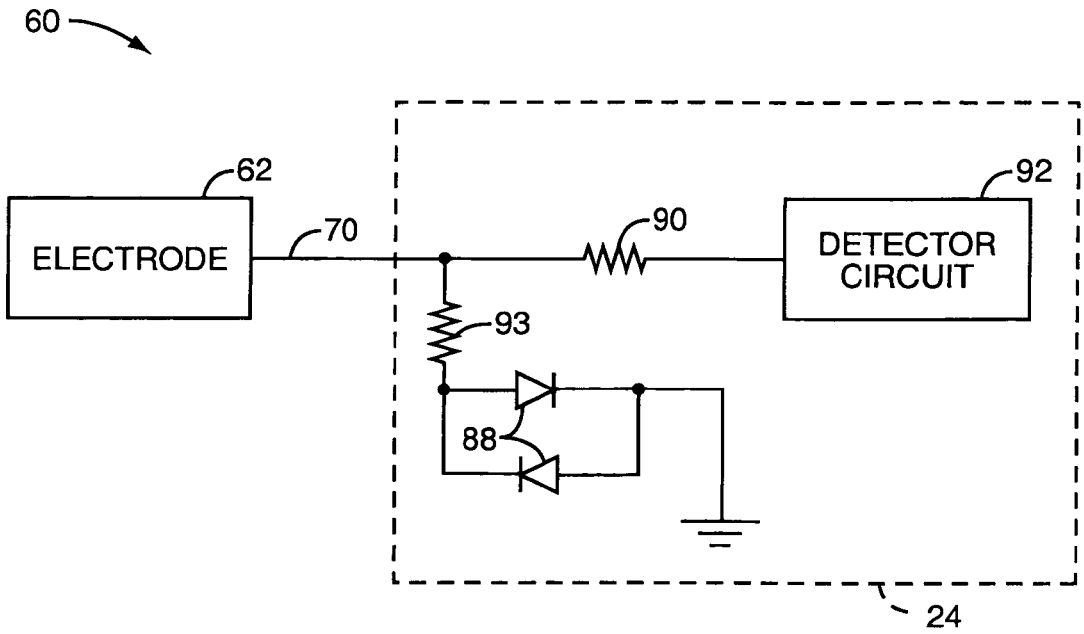
FIG. 5 illustrates a circuit diagram of an exemplary static charge sensor.

FIG. 5 illustrates an exemplary circuit diagram for the static charge sensor 60. The electrode, such as the generally hook shaped electrode 62, is connected to one or more clamp diodes 88, and then connected in series to a high value resistor 90 before being connected to a detector circuit 92 (FIG. 5). In a particularly contemplated embodiment, two clamp diodes 88 are used in parallel, clamping both positive and negative voltage as is well understood. The clamp diode 88 is protected by a series resistor 93, which prevents damage to the clamp diode 88 in the event of an accidental static hit. The clamp diode 88 prevents an electric surge from damaging down stream electronic components, such as the detector circuit 92. It should be appreciated that the generally hook shaped wire electrode 62 is connected to the clamp diode 88 via electrically conductive wire 70. Furthermore, the clamp diode 88, the high value resistor 90 and the detector circuit 92 may be considered part of the electronic components 24 positioned within the fuel dispenser 10. Alternatively, some or all of these elements may be positioned in the nozzle 20, with the electrically conductive wire 70 extending from the detector circuit 92 to the electronic components 24 of the fuel dispenser 10, and particularly to the dispenser controller 26. In an exemplary embodiment, the high value resistor 90 and the series resistor 93 are in the neighborhood of 20 kΩ. It should be appreciated that other circuits are also possible for the static charge sensor 60.

Figure 6:
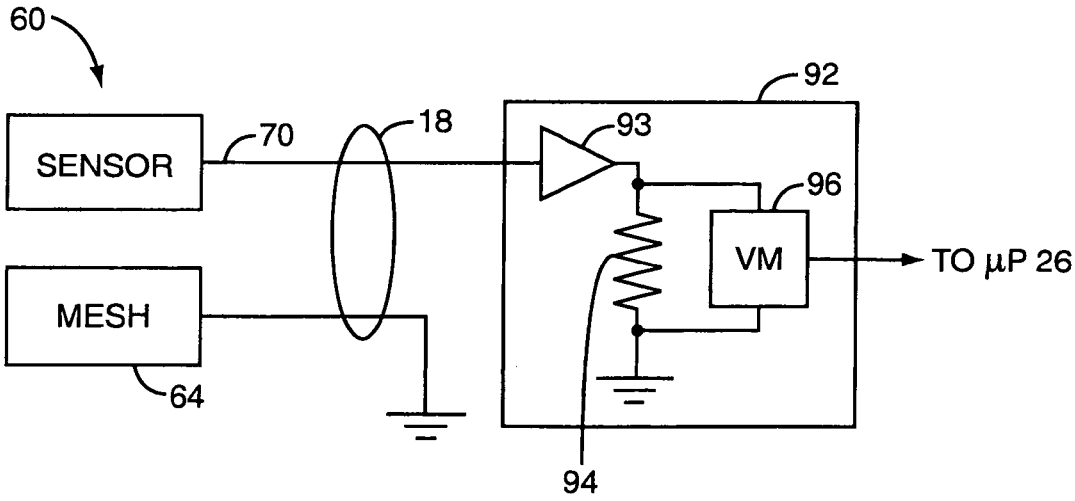
FIG. 6 illustrates a simplified version of a sensor and detector circuit according to the present invention.

FIG. 6 illustrates a more detailed schematic of the detector circuit 92 with the clamp diode 88 and high value resistor 90 eliminated. The static charge sensor 60 provides a current along electrically conductive wire 70 through the hose 18. Similarly, the wire mesh 64 couples to ground through the hose 18. The detector circuit 92 receives the current induced in the static charge sensor 60 by a static charge, and passes the current through an amplifier 93 and a resistive element 94 having a known resistive value. Thus, the signal from the electrode becomes an amplified signal. The amplified signal passes through the resistive element 94. A voltmeter (VM) 96 is connected in parallel to the resistive element 94 and provides an output signal to the dispenser controller 26, which compares the output signal to the predetermined threshold. Alternatively, a computer may be incorporated into the voltmeter 96 and compare the detected voltage to the predetermined voltage within the combined structure. In an exemplary embodiment, if the voltmeter 96 outputs a signal over a few millivolts, then the threshold of the present invention has been exceeded, and safety measures are invoked as explained in greater detail below. As yet another alternative, instead of detecting a voltage, a current could be detected in an appropriate manner. In the current sensing alternative, a lower impedance current detector would be used in place of the high impedance voltage detector.

While FIGS. 5 and 6 show exemplary circuits for the implementation of the static charge sensor 60 and detector circuit 92, it should be appreciated that other circuitry may be used in place thereof and the same function achieved. The precise details of the detector circuit 92 and the connection between the static charge sensor 60 and the detector circuit 92 are not critical to the present invention.

Figure 7:
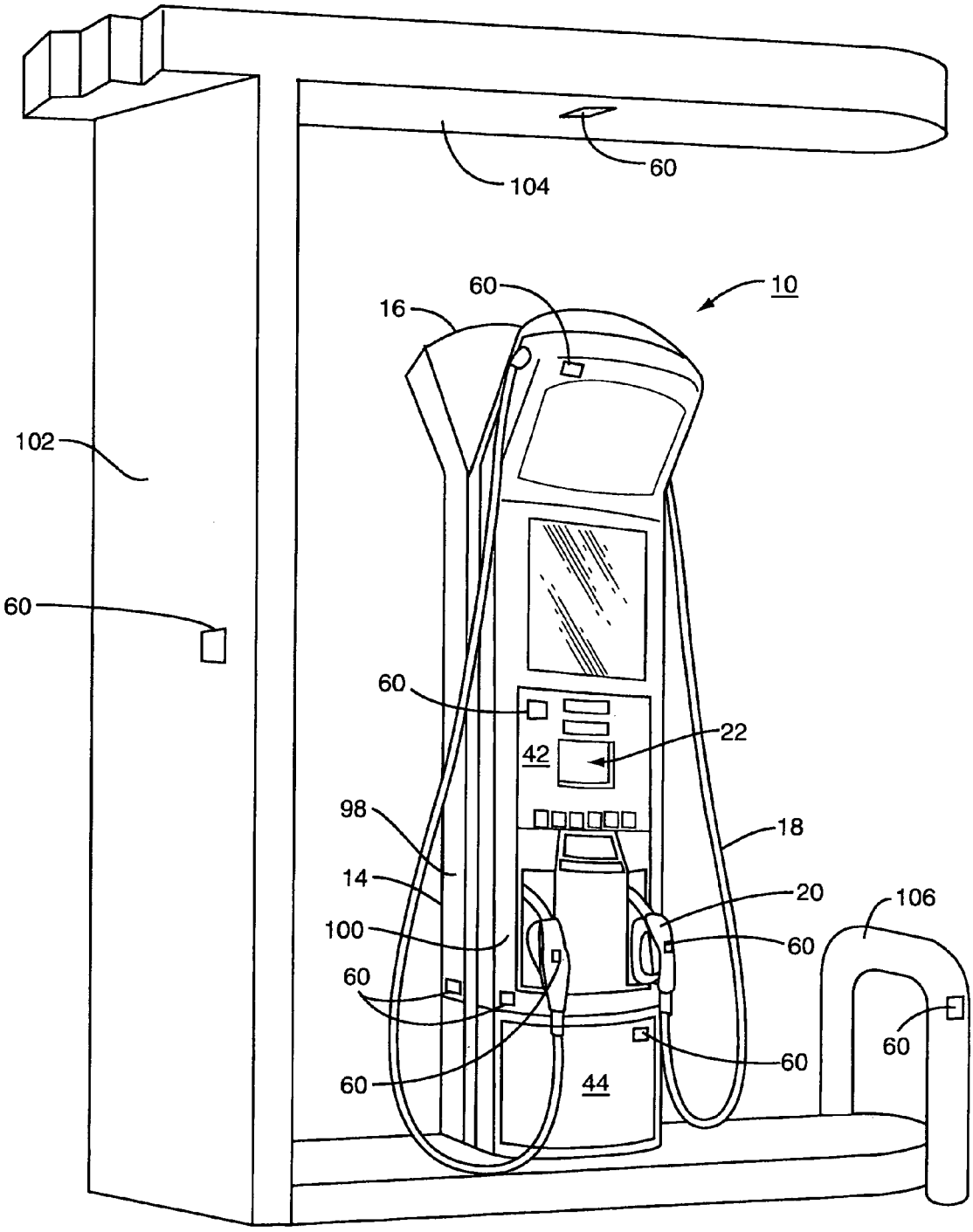
FIG. 7 illustrates a fuel dispenser with various static charge sensors according to the present invention.

While the previous discussion has focused on a static charge sensor 60 positioned in a nozzle 20 of the fuel dispenser 10, FIG. 7 shows a number of alternate placements for the static charge sensor 60. Specifically, the fuel dispenser 10 of FIG. 7 shows that the static charge sensors 60 may be positioned on the nozzle 20 as previously illustrated, on the side 98 of the fuel dispenser 10 proximate an edge 14, on the front 100 of the fuel dispenser 10 proximate an edge 14, on the door 44, in the user interface 22, on the door 42, or on the fuel dispenser canopy 16. While it is particularly contemplated that the static charge sensors 60 may be positioned proximate edges 14, these placements are not strictly required, and the static charge sensors 60 may be positioned where desired.

Furthermore, the static charge sensors 60 may be positioned proximate a fuel dispenser 10, but not necessarily within the housing 12. For example, the static charge sensor 60 may be on a canopy pillar 102, a canopy roof 104, a collision barrier 106, or other item in the forecourt of the fueling environment. Additionally, it is possible that the fuel dispenser 10 may have peripherals such as an advertising placard placed above the fuel dispenser 10 or the like. The static charge sensor 60 may be associated with such peripherals if needed or desired.

Figure 8:
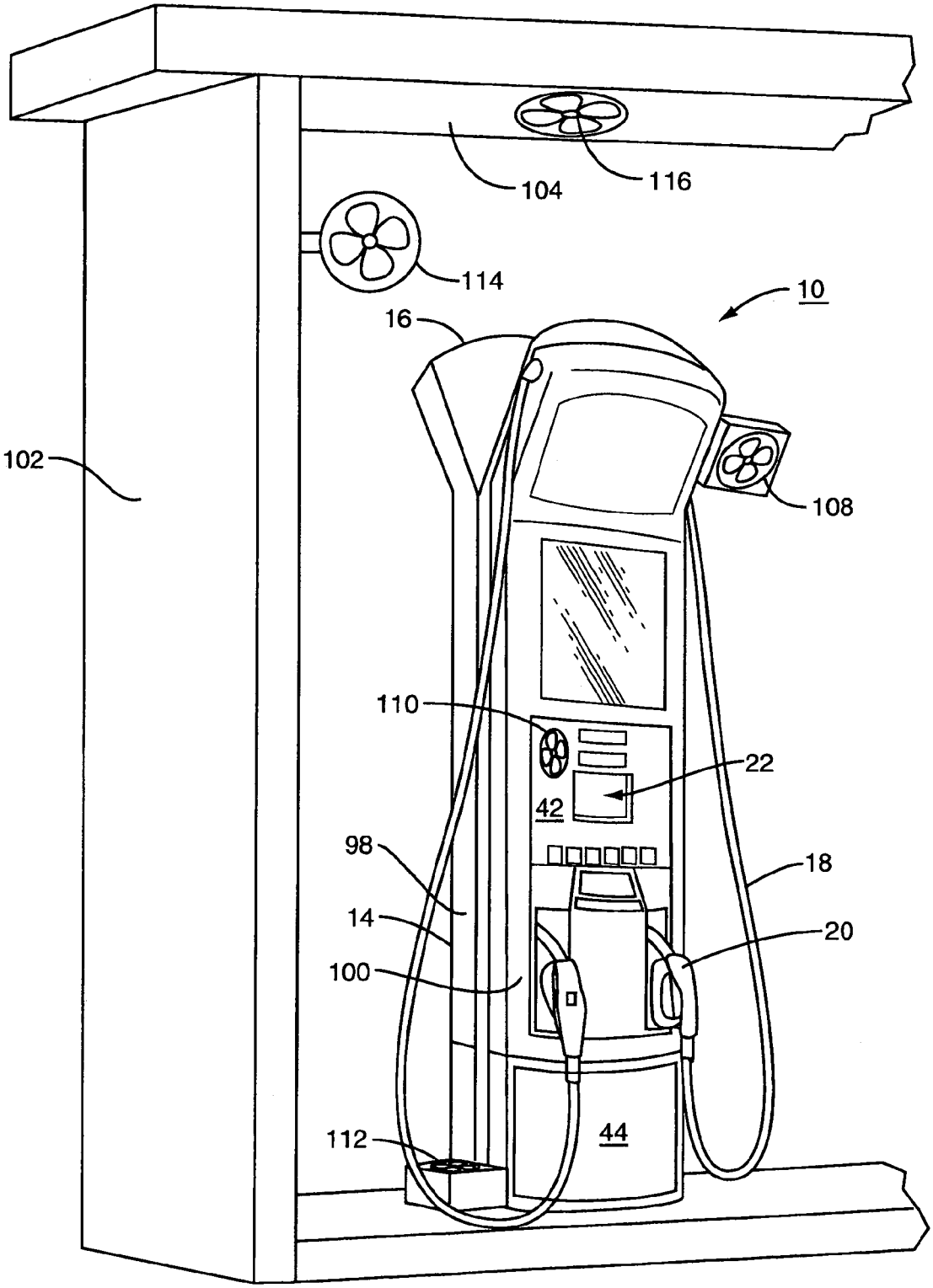
FIG. 8 illustrates some exemplary placements for safety measures according to the present invention.

The present invention also adds safety measures to the fueling environment in the form of a fan. Such fans will help disperse hydrocarbon vapors such that if a statically induced spark event occurs, there are no hydrocarbon vapors proximate the spark to cause an explosion. For example, as shown in FIG. 8, an upper fan 108 may be positioned on the fuel dispenser canopy 16 of the fuel dispenser 10. Alternatively, a face fan 110 may be built into the face of the fuel dispenser 10, such as in the user interface 22. Another option would be a bottom fan 112, which points upward from a lower portion of the fuel dispenser 10. As yet other options, the fans could be mounted some distance removed from the fuel dispenser 10, such as a pillar fan 114, mounted on the canopy pillar 102 or a canopy fan 116, mounted on the canopy roof 104. It should be appreciated that fans may be positioned in other locations as needed or desired.

Figure 9:
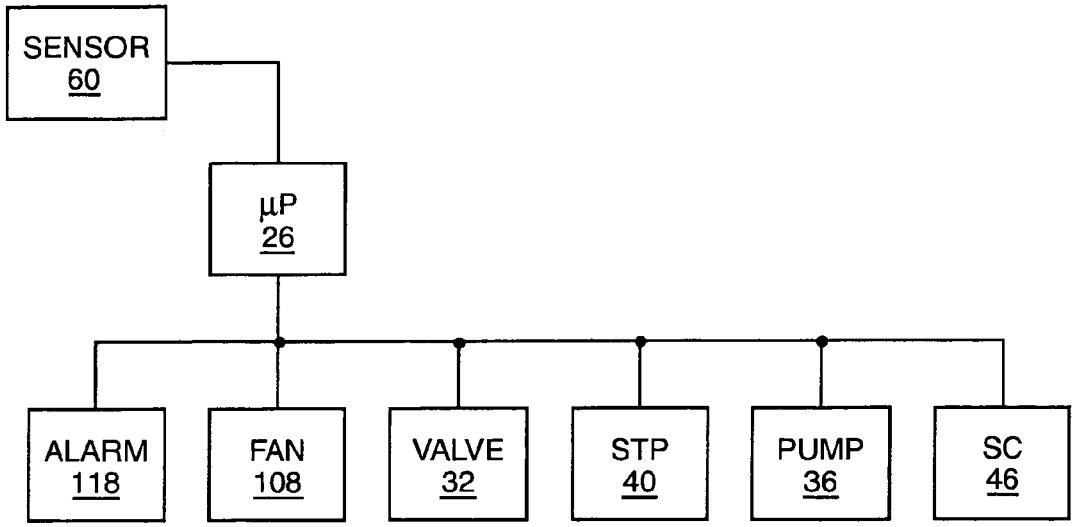
FIG. 9 illustrates a first control system to invoke safety-measures according to the present invention.

As noted above, the present invention initially detects whether a static charge is present and then activates one or more safety devices to minimize the risk of explosion in the event of a statically induced spark. In a first exemplary embodiment, illustrated schematically in FIG. 9, the dispenser controller 26 receives the voltage from the voltmeter 96 of the static charge sensor 60, determines if the voltage is greater than the predetermined threshold, and activates one or more safety devices. Specifically, upon determining that the static charge is above the predetermined threshold, the dispenser controller 26 may, if fuel dispenser pump 36 is present, turn off fuel dispenser pump 36. By preventing additional fuel from reaching the fuel dispenser 10, the potential for creation of additional hydrocarbon vapors proximate the fuel dispenser 10 is minimized.

Alternatively, if the fuel dispenser pump 36 is not present, the dispenser controller 26 may instruct the submersible turbine pump 40 to turn off. Again, by preventing additional fuel from reaching the fuel dispenser 10, the potential for harm is reduced. As another alternative, fuel control valve 32 may be closed. This effectively stops additional fuel from reaching the fuel handling components 34 of the fuel dispenser 10, reducing the potential for explosion. Alternatively, the dispenser controller 26 may turn on one or more fans, such as fans 108, 110, 112. When a fan is activated, it causes air to circulate, which in turn disperses the hydrocarbon vapors, such that the risk of harm is reduced.

As yet another alternative, the dispenser controller 26 may cause an alarm 118 to be generated. The alarm 118 may be audible or visual, and is typically implemented through the user interface 22, which includes audible and visual components, as is well understood. As still another alternative, the dispenser controller 26 may inform the site controller 46 of the static charge and the site controller 46 (SC) may react accordingly. It should be appreciated that one or more of these safety devices may be activated concurrently or sequentially. There is no strict requirement that only one safety device be present.

Figure 10:
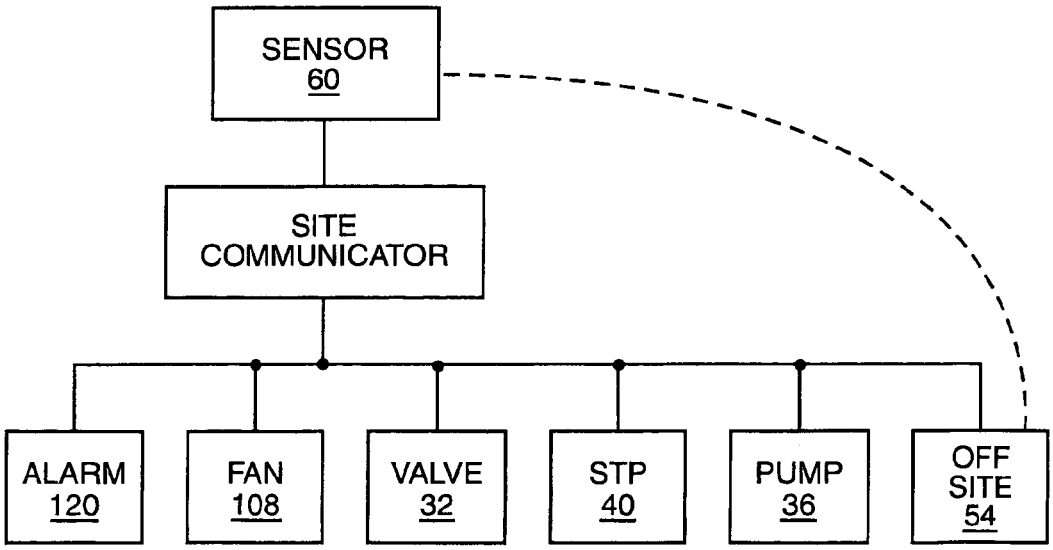
FIG. 10 illustrates a second control system to invoke safety measures according to the present invention.

In a second exemplary embodiment, illustrated schematically in FIG. 10, the static charge sensor 60 reports directly to a site communicator (such as the site controller 46 or the tank monitor 50). The static charge sensor 60 may report through the dispenser controller 26 as described above, or may report directly to the site communicator. In either event, the site communicator may then determine if the reported static charge exceeds the predetermined threshold, and if that determination is positive, activate one or more safety devices to implement a safety plan. Particularly contemplated safety plans include turning off the fuel control valve 32, turning off the fuel dispenser pump 36 if it is present, turning off the submersible turbine pump 40, reporting the condition to an off site location 54, turning on one or more fans (108, 110, 112, 114, or 116), or activating a site operator alarm 120 such that the site operator is alerted to the static charge condition. The site operator alarm 120 could be audible or visual as needed or desired. This arrangement is potentially better suited for those instances where the static charge sensor 60 and/or the safety device is removed from the fuel dispenser 10 because this eliminates the need for an electrical connection to the fuel dispenser 10. That is, if the static charge sensor 60 was positioned on the canopy pillar 102 as was the pillar fan 114, then there is no need to route wires through the fuel dispenser 10 to enable, use of the pillar fan 114 and the static charge sensor 60. Instead, this embodiment allows the static charge sensor 60 and the pillar fan 114 to be communicatively coupled to the site communicator and controlled by the site communicator.

As yet another embodiment, the present invention may also have the static charge sensor 60 report directly to the off site location 54 (as shown by the dotted line in FIG. 10), and the off site location 54 may activate one or more safety devices.

Figure 11:
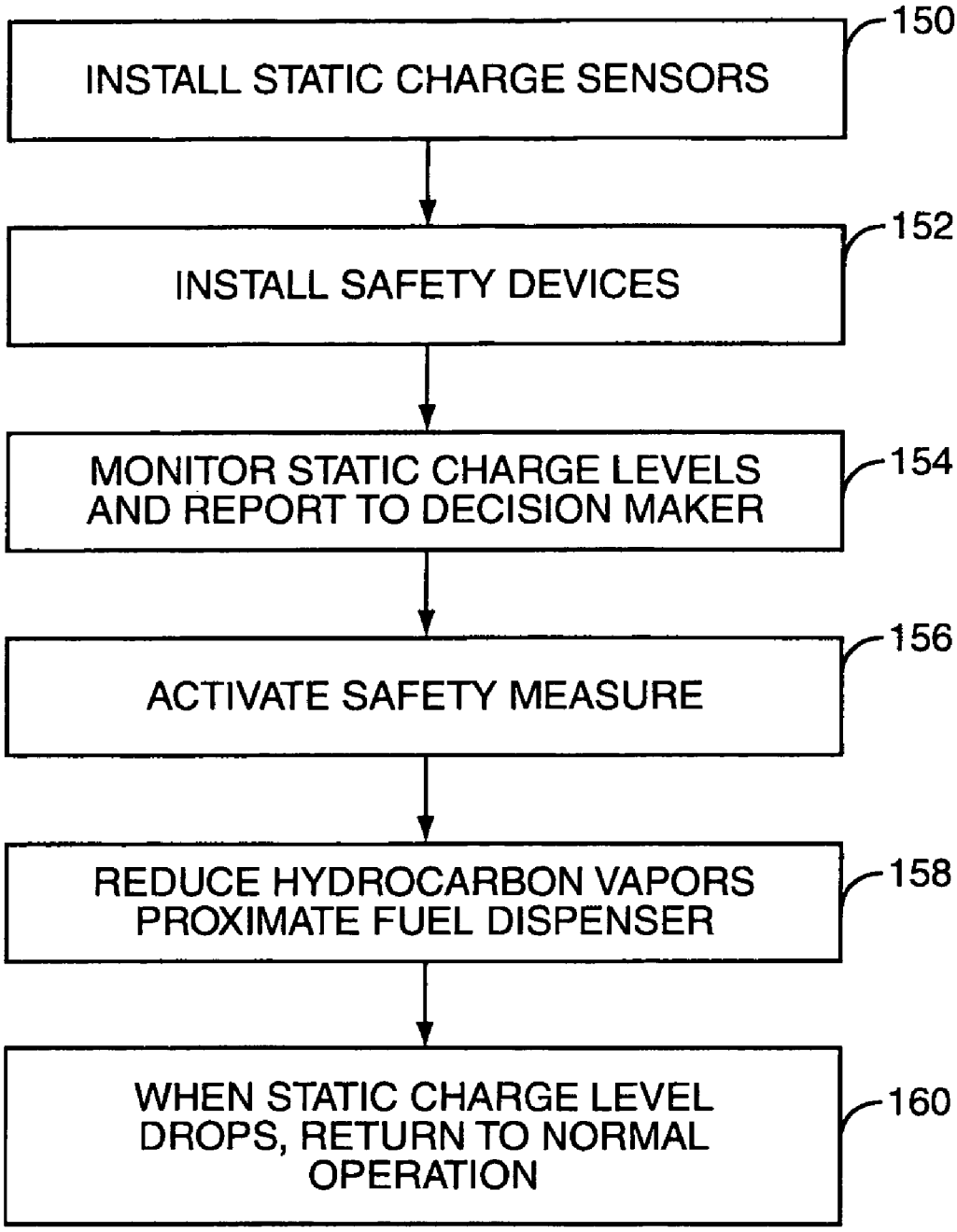
FIG. 11 illustrates a flow chart describing the methodology of the present invention.

A flow chart exemplifying the methodology of the present invention is illustrated in FIG. 11. Specifically, the present invention initially installs static charge sensors 60 (block 150). This installation may be accomplished through retrofitting existing fueling environments or installing new fuel dispensers 10 with static charge sensors 60 integrated thereinto. The present invention also requires the presence of the safety devices, and thus, the safety devices are installed (block 152). In some instances, the safety device is, present, but the control thereover is established in accordance with the present invention. For example, fuel control valves 32 are already present. However, the ability of the dispenser controller 26 or the site controller 46 to turn of the fuel control valve 32 in response to a static charge condition is implemented. Likewise, the fans 108, 110, 112, 114 and 116 or new safety devices may be installed in this step. It should be appreciated that the safety devices may be retrofit into existing fueling environments or integrated into new fuel dispensers 10 as needed or desired.

Having installed the static charge sensors 60 and the safety devices, the deployed static charge sensors 60 monitor static charge levels and report output relating thereto to a decision maker (block 154). As alluded to above, the decision maker could be the dispenser controller 26, the site communicator, the off site location 54, or even the static charge sensor 60 as needed or desired. When the decision maker determines that the sensed static charge is above the predetermined threshold, the decision maker then activates one or more safety measures (block 156). As noted above, the activation of the safety measure may be turning on a fan 108, closing the fuel control valve 32, turning off the fuel dispenser pump 36, turning off the submersible turbine pump 40, generating the alarm 118 or the like. Likewise, more than one safety measure may be activated as needed or desired. The purpose of the safety measure is to disperse or reduce hydrocarbon vapors proximate the fuel dispenser 10 (block 158).

Once the decision maker has determined that the static charge level sensed by the static charge sensors 60 is below the predetermined threshold, the fueling environment operation returns to normal (block 160).

Other reasonable permutations of the present invention are also contemplated. For example, the static charge sensors 60 may detect excursions in either polarity. That is, either a positive or a negative charge may be sensed with the appropriate detection circuitry.

Those skilled in the art will recognize improvements and modifications to the preferred embodiments of the present invention. All such improvements and modifications are considered within the scope of the concepts disclosed herein and the claims that follow.

What is claimed is:

1. A fuel dispenser that dispenses fuel from a storage tank, comprising:

a static charge sensor adapted to sense static charge levels in an ambient environment outside of and proximate the fuel dispenser; and a safety device adapted to operate when the static charge sensor senses a static charge in said ambient environment above a predetermined threshold.

2. The fuel dispenser of claim 1, further comprising a dispenser controller operatively associated with the static charge sensor and the safety device.

3. The fuel dispenser of claim 1, wherein the safety device comprises a fan.

4. The fuel dispenser of claim 3, wherein a position of the fan is selected from the group consisting of: a fuel dispenser face, a fuel dispenser canopy, a fuel dispenser side, proximate an edge of a fuel dispenser body, and removed from the fuel dispenser.

5. The fuel dispenser of claim 1, wherein the safety device is selected from the group consisting of: a fuel control valve, a fuel dispenser pump, a fueling environment fuel pump, and an alarm.

6. The fuel dispenser of claim 4, further comprising a dispenser controller, the dispenser controller adapted to perform a function in response to a static charge being sensed, the function selected from the group consisting of: turn off a fuel control valve, turn off a fuel dispenser pump, turn off a fueling environment pump, and turn on an alarm.

7. The fuel dispenser of claim 1, wherein the static charge sensor comprises an electrode adapted to generate a signal when the static charge is present, an amplifier adapted to amplify the signal to create an amplified signal, and a threshold detector adapted to compare the amplified signal to the predetermined threshold.

8. The fuel dispenser of claim 7, wherein the electrode comprises an electrode with a pointed terminal end.

9. The fuel dispenser of claim 7, wherein the electrode comprises an electrode with a curved terminal end adapted to concentrate the static charge so as to produce the signal.

10. The fuel dispenser of claim 1, wherein the static charge sensor is adapted to provide a signal to a remote controller, and the safety device is adapted to be activated by the remote controller.

11. The fuel dispenser of claim 1, further comprising a dispenser housing, and the static charge sensor is positioned in the dispenser housing.

12. The fuel dispenser of claim 9, wherein the dispenser housing comprises an edge, and the static charge sensor is positioned proximate the edge.

13. The fuel dispenser of claim 9, wherein the dispenser housing comprises a dispenser canopy and the static charge sensor is associated with the dispenser canopy.

14. The fuel dispenser of claim 1, wherein the static charge sensor is protected from accidental contact by a physical barrier.

15. The fuel dispenser of claim 1, further comprising a nozzle that dispenses the fuel, wherein the static charge sensor is positioned on the nozzle.

16. The fuel dispenser of claim 15, wherein the static charge sensor is positioned in a cavity within the nozzle, and the static charge sensor comprises an electrode, a mesh adapted to protect the electrode from physical contact by a user.

17. The fuel dispenser of claim 16, wherein the cavity is positioned on an anterior surface of the nozzle.

18. A method of sensing a static charge in an ambient environment outside of and proximate to a fuel dispenser, comprising:

associating a static charge sensor with the fuel dispenser;

sensing static charge levels in the ambient environment with the static charge sensor; and activating a safety device if the static charge sensor detects a static charge above a predetermined threshold.

19. The method of claim 18, wherein associating a static charge sensor with a fuel dispenser comprises positioning the static charge sensor on a fuel dispenser housing.

20. The method of claim 18, wherein associating a static charge sensor with a fuel dispenser comprises positioning the static charge sensor on a canopy pillar proximate the fuel dispenser.

21. The method of claim 18, wherein associating a static charge sensor with a fuel dispenser comprises positioning the static charge sensor on a canopy positioned over the fuel dispenser.

22. The method of claim 18, wherein associating a static charge sensor with a fuel dispenser comprises positioning the static charge sensor on a crash barrier proximate the fuel dispenser.

23. The method of claim 18, wherein associating a static charge sensor with a fuel dispenser comprises associating a static charge sensor comprising an electrode with the fuel dispenser.

24. The method of claim 23, wherein associating a static charge sensor comprising an electrode with the fuel dispenser comprises associating a static charge sensor comprising an electrode with a pointed terminal end with the fuel dispenser.

25. The method of claim 23, wherein associating a static charge sensor comprising an electrode with the fuel dispenser comprises associating a static charge sensor comprising an electrode with a J-shaped terminal end with the fuel dispenser.

26. The method of claim 18, wherein activating a safety device comprises turning on a fan.

27. The method of claim 18, wherein activating a safety device comprises activating a safety device selected from the group consisting of: a fuel flow valve, a fuel dispenser pump, a fueling environment fuel pump, and an alarm.

28. The method of claim 18, further comprising reporting sensed static charge levels to a dispenser controller.

29. The method of claim 18, further comprising reporting sensed static charge levels to a remote controller.

30. The method of claim 18, further comprising protecting the static charge sensor from accidental contact with a physical barrier.

31. Apparatus comprising:

a fuel dispenser comprising a static charge sensor adapted to sense static charge levels in an ambient environment outside of and proximate the fuel dispenser;

a safety device; and a controller adapted to receive sensed static charge levels from the static charge sensor and activate the safety device.

32. The apparatus of claim 31, wherein the controller comprises a dispenser controller.

33. The apparatus of claim 32, wherein the dispenser controller is adapted to perform a function in response to a static charge being sensed, the function selected from the group consisting of: turn off a fuel control valve, turn on a fan, turn off a fuel dispenser pump, turn off a fueling environment pump, and generate an alarm.

34. The apparatus of claim 31, wherein the controller comprises a site controller.

35. The apparatus of claim 34, wherein the site controller is adapted to perform a function in response to a static charge being sensed, the function selected from the group consisting of: turn off the fuel control valve, turn off the fuel dispenser pump, turn on a fan, turn off the fueling environment pump, and generate an alarm.

36. The apparatus of claim 31, wherein the safety device comprises a fan.

37. The apparatus of claim 36, wherein the fan is mounted in a position selected from the group consisting of: a fuel dispenser face, a fuel dispenser canopy, a canopy pillar, a canopy, and a lower portion of the fuel dispenser.

38. The apparatus of claim 31, wherein the safety device comprises a device selected from the group consisting of: an alarm, a fuel control valve, a fuel dispenser pump, and a fueling environment pump.

39. The apparatus of claim 31, wherein the static charge sensor is positioned on the fuel dispenser.

40. The apparatus of claim 31, wherein the static charge sensor is associated with the fuel dispenser.

41. The apparatus of claim 31, wherein the static charge sensor is proximate the fuel dispenser, but not on the fuel dispenser.

42. The apparatus of claim 41, wherein the static charge sensor is positioned on a location selected from the group consisting of: a canopy pillar, a canopy, and a crash barrier.

43. The apparatus of claim 31, wherein the fuel dispenser comprises a body comprising an edge and the static charge sensor is positioned proximate the edge.

44. The apparatus of claim 31, wherein the fuel dispenser comprises a dispenser canopy, and the static charge sensor is associated with the dispenser canopy.

45. The apparatus of claim 31, wherein the static charge sensor comprises an electrode adapted to generate a signal if a static charge is present, an amplifier adapted to receive the signal and amplify the signal into an amplified signal, and a threshold detector.

46. The apparatus of claim 45, wherein the electrode comprises an electrode with a pointed terminal end.

47. The apparatus of claim 45, wherein the electrode comprises an electrode with a J-shaped portion.

48. The apparatus of claim 31, further comprising a physical barrier adapted to protect the static charge sensor from accidental contact.

* * * * *